US006623310B1

(12) United States Patent
Billman et al.

(10) Patent No.: US 6,623,310 B1
(45) Date of Patent: Sep. 23, 2003

(54) HIGH DENSITY ELECTRICAL CONNECTOR ASSEMBLY WITH REDUCED INSERTION FORCE

(75) Inventors: Timothy B. Billman, Dover, PA (US); Iosif R. Korsunsky, Harrisburg, PA (US)

(73) Assignee: Hon Hai Precision Ind. Co., Ltd., Taipei (TW)

( * ) Notice: Subject to any disclaimer, the term of this patent is extended or adjusted under 35 U.S.C. 154(b) by 0 days.

(21) Appl. No.: 10/192,109

(22) Filed: Jul. 9, 2002

(65) Prior Publication Data

(65)

Related U.S. Application Data

(63) Continuation-in-part of application No. 10/154,318, filed on May 22, 2002, which is a continuation-in-part of application No. 10/152,936, filed on May 21, 2002.

(51) Int. Cl.[7] ..... H01R 13/502
(52) U.S. Cl. ..... 439/701
(58) Field of Search ..... 439/680, 608, 439/108, 701, 79, 65, 76.1

(56) References Cited

U.S. PATENT DOCUMENTS 5,924,899 A * 7/1999 Paagman ..... 439/701
6,152,747 A * 11/2000 McNamara ..... 439/108
6,171,115 B1 * 1/2001 Mickievicz et al. ..... 439/76.1
6,375,508 B1 * 4/2002 Pickles et al. ..... 439/608
6,379,188 B1 * 4/2002 Cohen et al. ..... 439/608
6,390,857 B1 * 5/2002 Pickles et al. ..... 439/680
6,461,202 B2 * 10/2002 Kline ..... 439/701
6,506,076 B2 * 1/2003 Cohen et al. ..... 439/608

* cited by examiner

*Primary Examiner*—Ross Gushi
(74) *Attorney, Agent, or Firm*—Wei Te Chung

(57) ABSTRACT

An electrical connector assembly includes an electrical receptacle connector (100; 300) and an electrical header connector (200; 400). The electrical receptacle connector includes an insulative housing (110; 310), a number of wafers (130; 350) accommodated in the insulative housing, and a number of inner printed circuit boards (120; 320). Each wafer has a wafer body (131; 3113), a number of signal contacts (132; 330) and a grounding bus (133; 340). Each inner printed circuit board has a mounting portion (124; 324) extending between two adjacent wafers to electrically contact with the signal contacts and the grounding buses and a mating portion (123; 323). The electrical header connector has an insulative housing (210; 410) and a number of wafers (220; 440) accommodated in the insulative housing to receive therebetween and electrically contact with the mating portions of the inner printed circuit boards of the electrical receptacle connector.

19 Claims, 22 Drawing Sheets

HIGH DENSITY ELECTRICAL CONNECTOR ASSEMBLY WITH REDUCED INSERTION FORCE

CROSS-REFERENCE TO RELATED APPLICATIONS

This is a Continuation-In-Part (CIP) of U.S. patent application Ser. No. 10/152,936 filed on May 21, 2002, entitled "ELECTTICAL CONNECTOR"; a CIP of U.S. patent application Ser. No. 10/154,318 filed on May 22, 2002 entitled "HIGH DENSITY ELECTRICAL CONNECTOR"; and related to U.S. patent application Ser. No. 09/746,088 filed on Dec. 21, 2000, entitled "ELECTRICAL CONNECTOR HAVING LEADING CAP FOR FACILITATING PRINTED CIRCUIT BOARD IN THE CONNECTOR INTO A MATING CONNECTOR", now issued as U.S. Pat. No. 6,390,857 on May 21, 2002; U.S. patent application Ser. No. 09/749,086 filed on Dec. 26, 2000, entitled "ELECTRICAL CONNECTOR ASSEMBLY HAVING THE SAME CIRCUIT BOARDS THEREIN", now issued as U.S. Pat. No. 6,375,508 on Apr. 23, 2002; U.S. patent application Ser. Nos. 10/150,638, 10/162,724, 10/152,540, 10/161,471 and 10/165,576, filed respectively on May 17, 2002, Jun. 4, 2002, May 20, 2002, May 30, 2002 and Jun. 21, 2002, entitled respectively "ELECTRICAL CONNECTOR HAVING PRINTED SUBSTRATES THEREIN ELECTRICALLY CONTACTING CONDUCTIVE CONTACTS THEREOF BY SOLDERLESS", "HIGH DENSITY ELECTRICAL CONNECTOR WITH LEAD-IN DEVICE", "CONTACT FOR ELECTRICAL CONNECTOR", "HIGH DENSITY ELECTRICAL CONNECTOR WITH IMPROVED GROUNDING BUS", "CONTACT FOR ELECTRICAL CONNECTOR". All of the above U.S. patent applications are assigned to the same assignee as this patent application and disclosures thereof are all incorporated herein for reference.

BACKGROUND OF THE INVENTION

1. Field of the Invention

The present invention relates to electrical connectors, and particularly to high density electrical connector assemblies for electrically interconnecting printed circuit boards.

2. Description of the Related Art

An arrangement for joining several printed circuit boards is to have one printed circuit board serve as a backplane and other printed circuit boards, called daughter boards, connected through the backplane. The backplane is usually provided with many connectors. Conducting traces in the printed circuit board connect signal pins in the connectors so that signals may be routed between the connectors. The daughter boards also contain connectors that are plugged into the connectors on the backplane. In this way, signals are routed among the daughter boards through the backplane.

Continued advances in the design of electronic devices for data processing and communications systems have placed rigorous demands on the design of electrical connectors. Specifically, electrical connectors for electrically connecting the backplanes and the daughter boards need to have higher densities and pin counts for design advances which increase integration of solid state devices and which increase the speed of data processing and communication. However, the increased density and pin counts unavoidably add the difficulties of mounting the electrical connectors to the backplanes and/or the daughter boards and of mating the electrical connector on the daughter board with the electrical connector on the backplane, and so on.

U.S. Pat. No. 5,975,921 issued on Nov. 2, 1999 discloses a high density electrical connector and is devoted to solve the problems of how to mount the high density electrical connector to a printed circuit board.

U.S. Pat. No. 6,220,896 issued on Apr. 24, 2001 is directed to a high density electrical connector which uses the stripline configuration to reduce the cross talk between signal contacts thereof.

U.S. Pat. No. 6,227,882 issued on May 8, 2001 discloses a high density electrical connector balancing the forces between electrical contacts thereof and of an electrical connector complementary therewith.

U.S. Pat. No. 6,299,484 issued on Oct. 9, 2001 discloses a high density electrical connector, a shielding plate of which is mechanically supported by and electrically connected with one of a column of electrical contacts thereof.

U.S. Pat. Nos. 6,179,663 and 6,206,729 issued respectively on Jan. 30, 2001 and Mar. 27, 2001 respectively disclose a high density electrical interconnect system having each of a first and a second electrical connectors thereof use multiple grounding methods to reduce or prevent spurious signals from interfering with high density contacts carrying high speed transmissions.

None of the electrical connector assemblies of the above-mentioned patents addresses the difficulties of mating the high density electrical connectors. Therefore, an improved electrical connector assembly is desired.

SUMMARY OF THE INVENTION

A major object of the present invention is to provide a high density electrical connector assembly comprising an electrical receptacle connector and an electrical header connector and reducing an insertion force needed to mate the electrical receptacle connector and the electrical header connector.

A high density electrical connector assembly in accordance with the present invention comprises an electrical receptacle connector mounted to a first printed circuit board and an electrical header connector complementary to the electrical receptacle connector and mounted to a second printed circuit board. The electrical receptacle connector comprises an insulative housing, a plurality of wafers accommodated in the insulative housing, and a plurality of inner printed circuit boards each comprising a mating portion and a mounting portion. Each wafer comprises a wafer body, a plurality of signal contacts mounted to one side of the wafer body, and a grounding bus mounted to the wafer body and each comprising a plurality of fingers extending along the one side of the wafer body and a plurality of tabs extending along the other side of the wafer body. The mounting portion of each inner printed circuit board is inserted between two adjacent wafers and electrically contacts with the signal contacts and fingers of one wafer and tabs of another adjacent wafer. The signal contacts, the fingers and the tabs are stagger with respect to each other.

The electrical header connector comprises an insulative housing and a plurality of wafers accommodated in the insulative housing for receiving therebetween and electrical engaging with the mating portions of the inner printed circuit boards of the electrical receptacle connector during the mating of the two electrical connectors. Each wafer comprises a wafer body, a plurality of signal contacts mounted to one side of the wafer body for electrically engaging with the inner printed circuit board, and a grounding bus mounted to the wafer body and each comprising a plurality of fingers and tabs for electrically contacting the inner printed circuit board. The signal contacts, the fingers and the tabs of the grounding buses are stagger with respect to each other.

Other objects, advantages and novel features of the invention will become more apparent from the following detailed description of the present embodiment when taken in conjunction with the accompanying drawings.

DETAILED DESCRIPTION OF THE INVENTION

Figure 1:
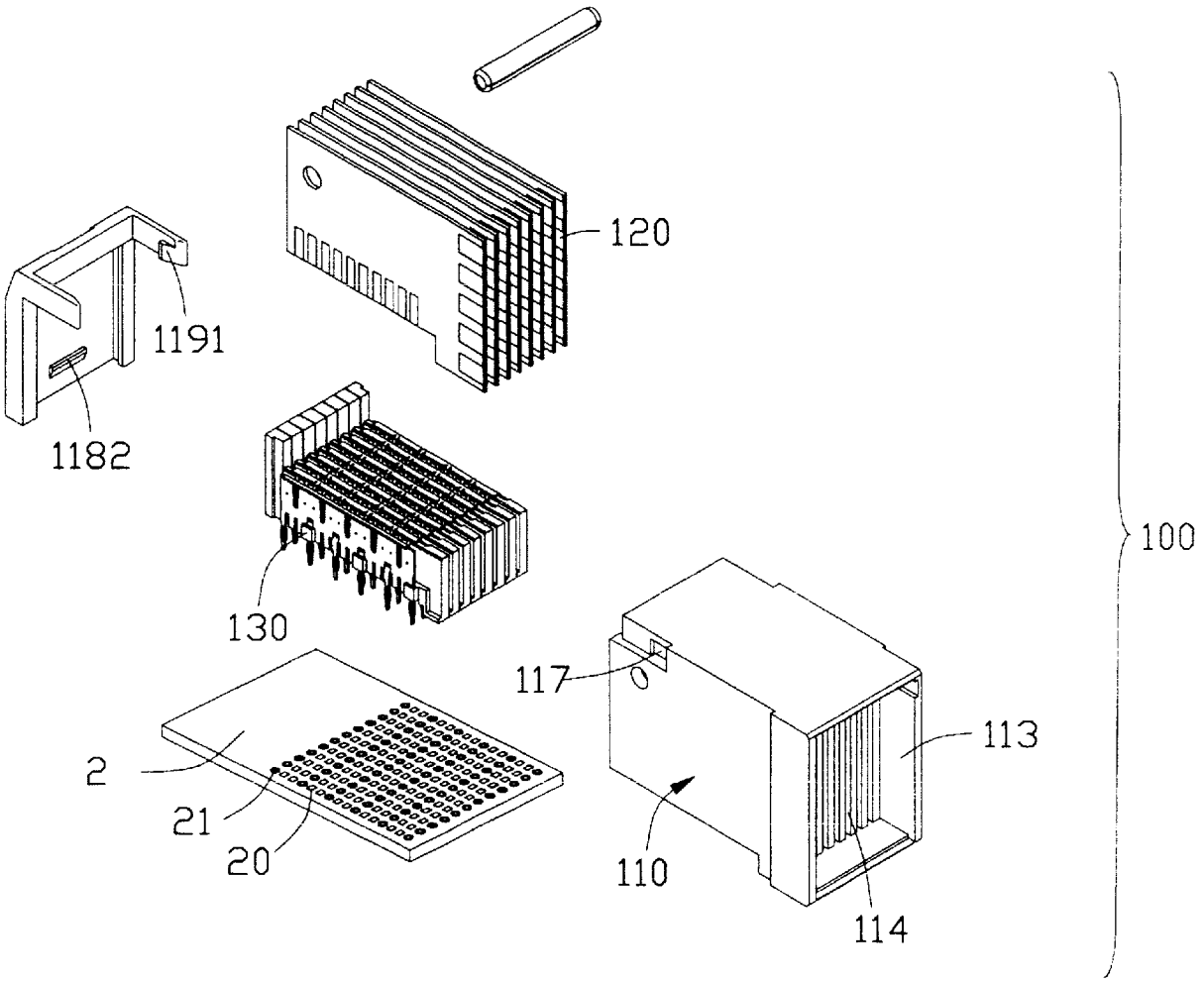
FIG. 1 is an exploded view of an electrical receptacle connector of a high density electrical connector assembly in accordance with a first embodiment of the present invention and a printed circuit board to which the electrical receptacle connector is mounted.
Figure 2:
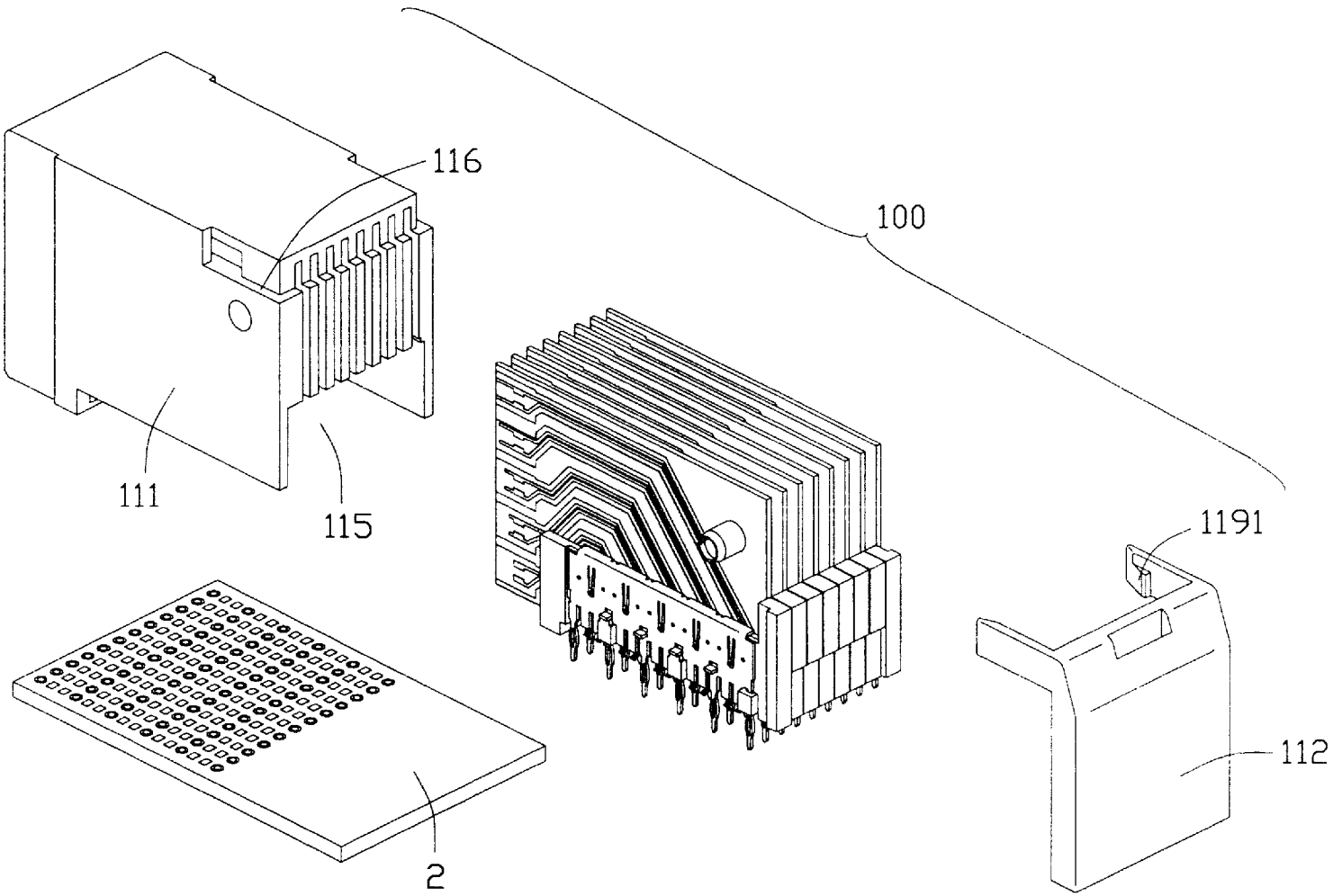
FIG. 2 is a view similar to FIG. 1 but taken from another perspective.
Figure 3:
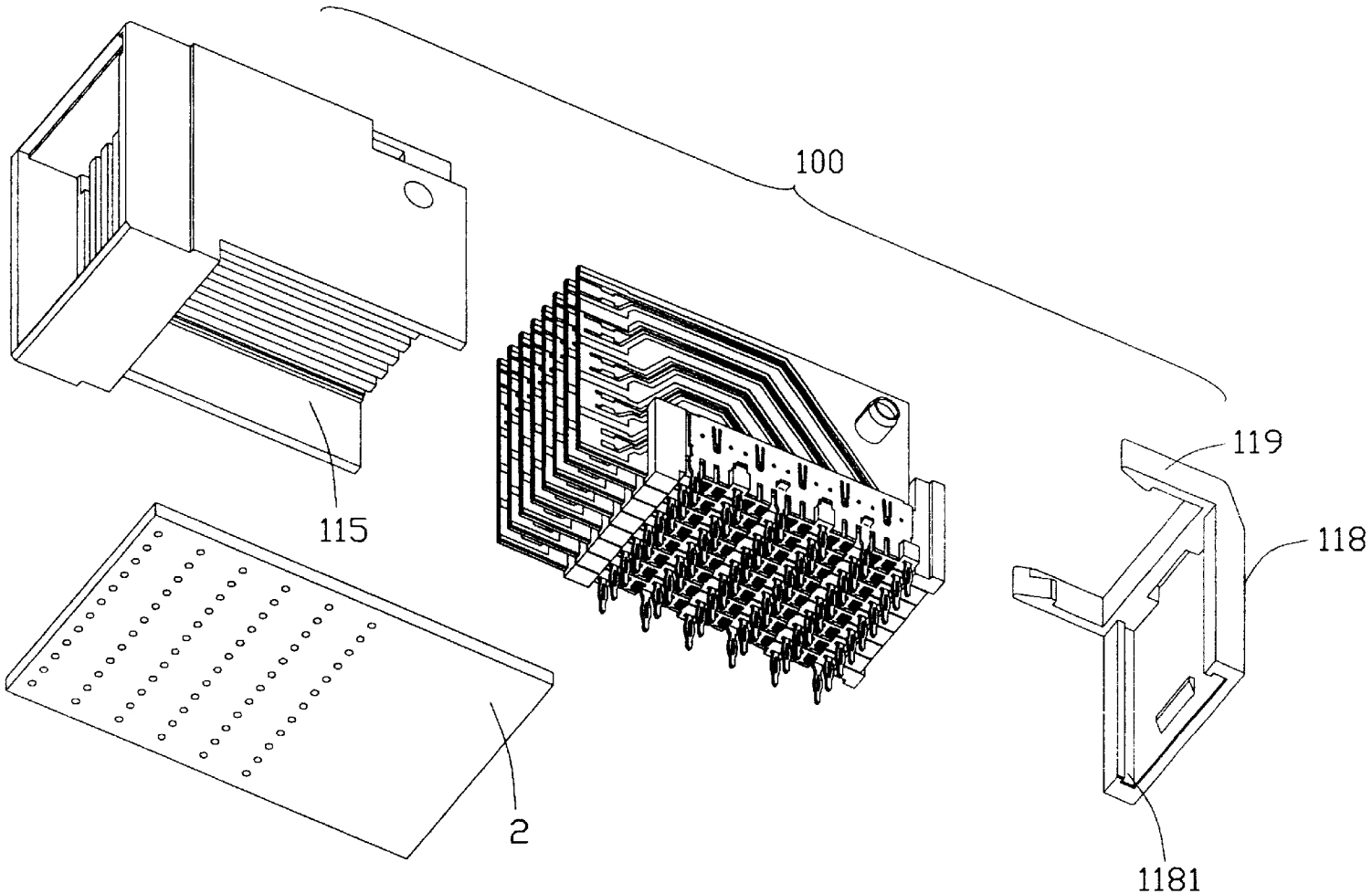
FIG. 3 is a view similar to FIG. 1 but taken from yet another perspective.
Figure 4:
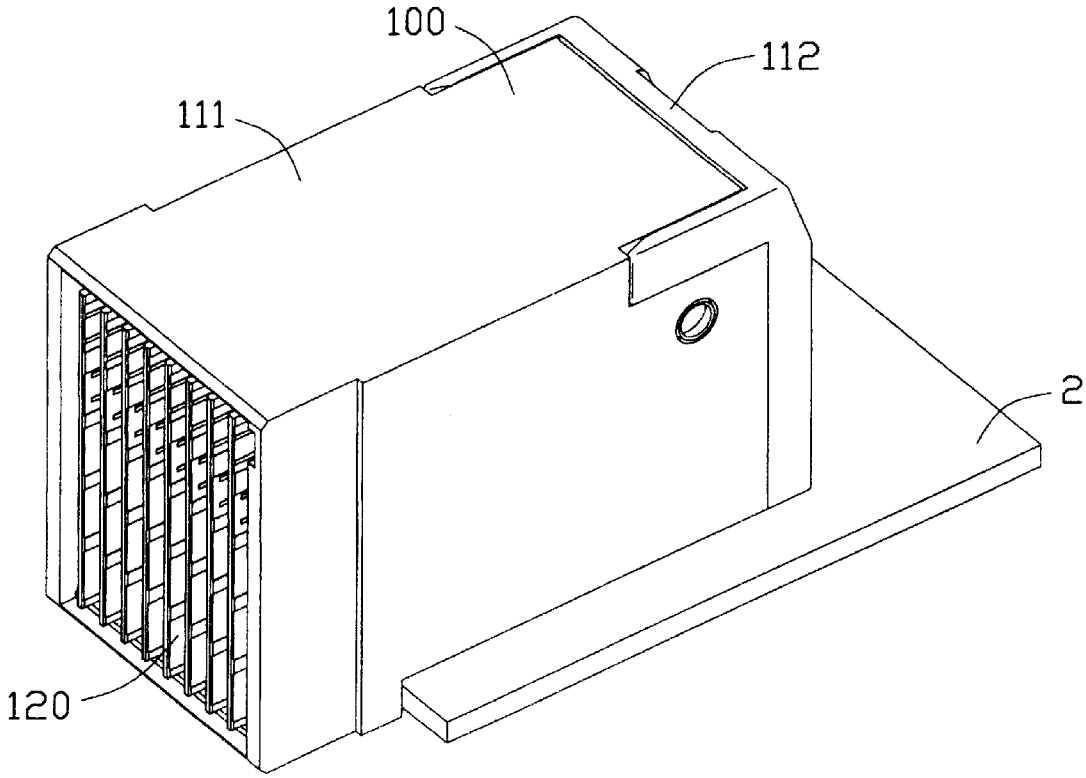
FIG. 4 is an assembled perspective view of FIG. 1.

Referring to FIGS. 1 to 4, an electrical receptacle connector 100 of a high speed electrical connector assembly in accordance with a first embodiment of the present invention is adapted for mounting to a printed circuit board 2 and comprises an insulative housing 110, a plurality of inner printed circuit boards 120, and a plurality of wafers 130. The printed circuit board 2 comprises a plurality of contacting pads 20 on a surface thereof to which the electrical receptacle connector 100 is mounted and a plurality of through holes 21 extending therethrough.

The insulative housing 110 comprises a main portion 111 and a fastening portion 112. The main portion 111 defines a mating cavity 113 recessed from a front surface thereof, a plurality of slots 114 extending therethrough and opening to the mating cavity 113, and a mounting cavity 115 recessed in a rear and bottom portion thereof and communicating with the slots 114. The main portion 111 further defines a pair of opposite locking channels 116 at a rear top end thereof and a pair of cutouts 117 respectively opening to the locking channels 116. The fastening portion 112 comprises a cover section 118 and a pair of latches 119 extending forwardly from two opposite top sides of the cover section 118. The cover section 118 defines a pair of opposite channels 1181 extending vertically therethrough and a block 1182 protruding forwardly from an inner surface adjacent to a lower end thereof. Each latch 119 is formed with a hook section 1191 at a forward end thereof.

Figure 5:
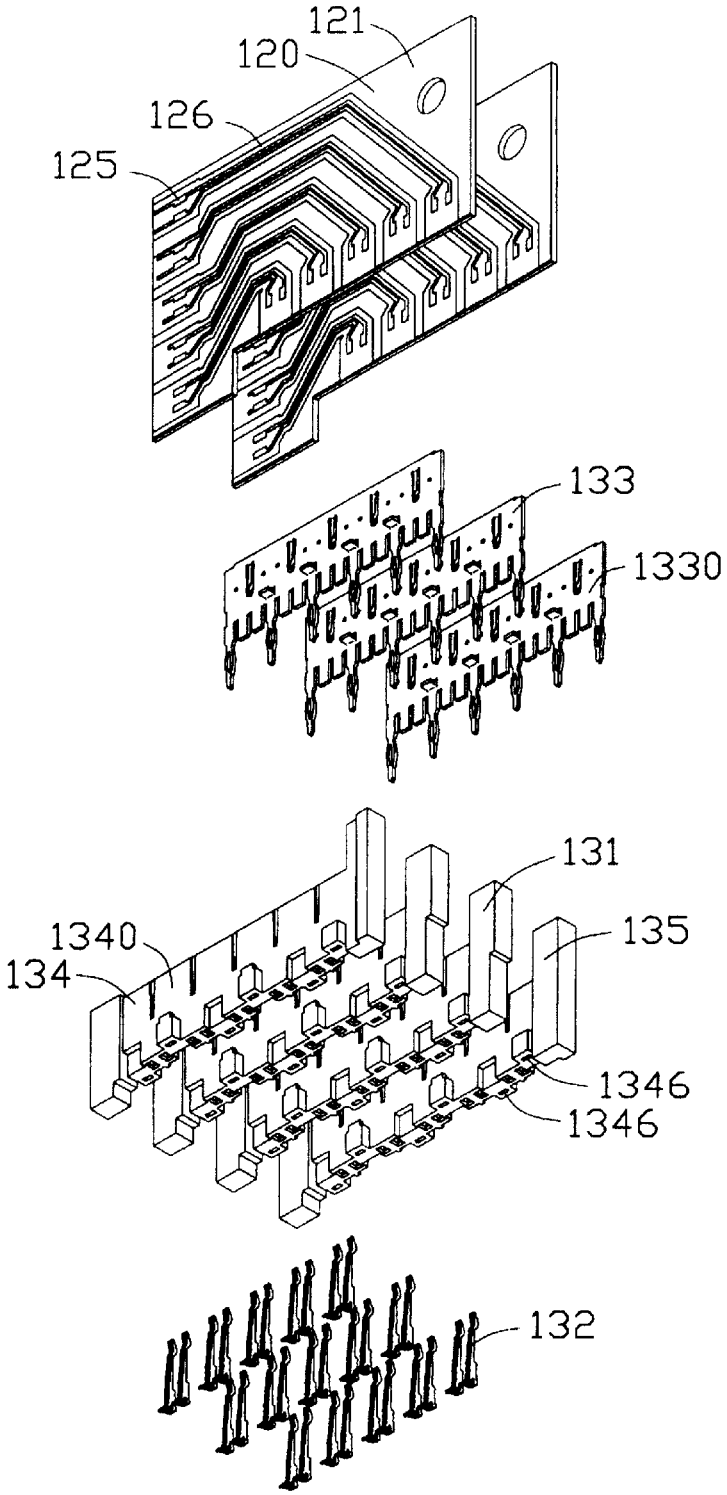
FIG. 5 is an exploded perspective view of wafers and inner printed circuit boards of the electrical receptacle connector of FIG. 1.
Figure 6:
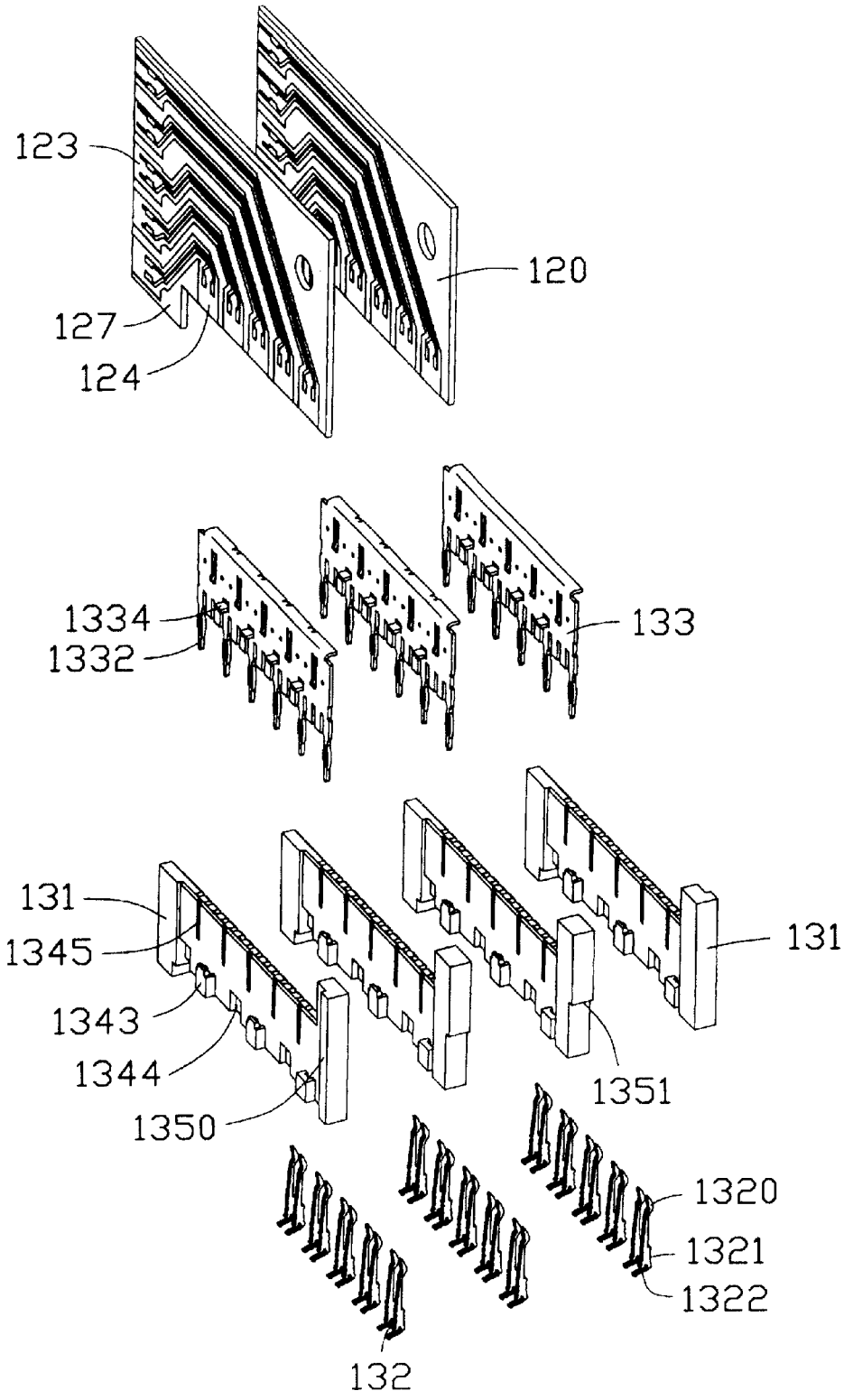
FIG. 6 is a view similar to FIG. 5, but taken from another perspective.
Figure 7:
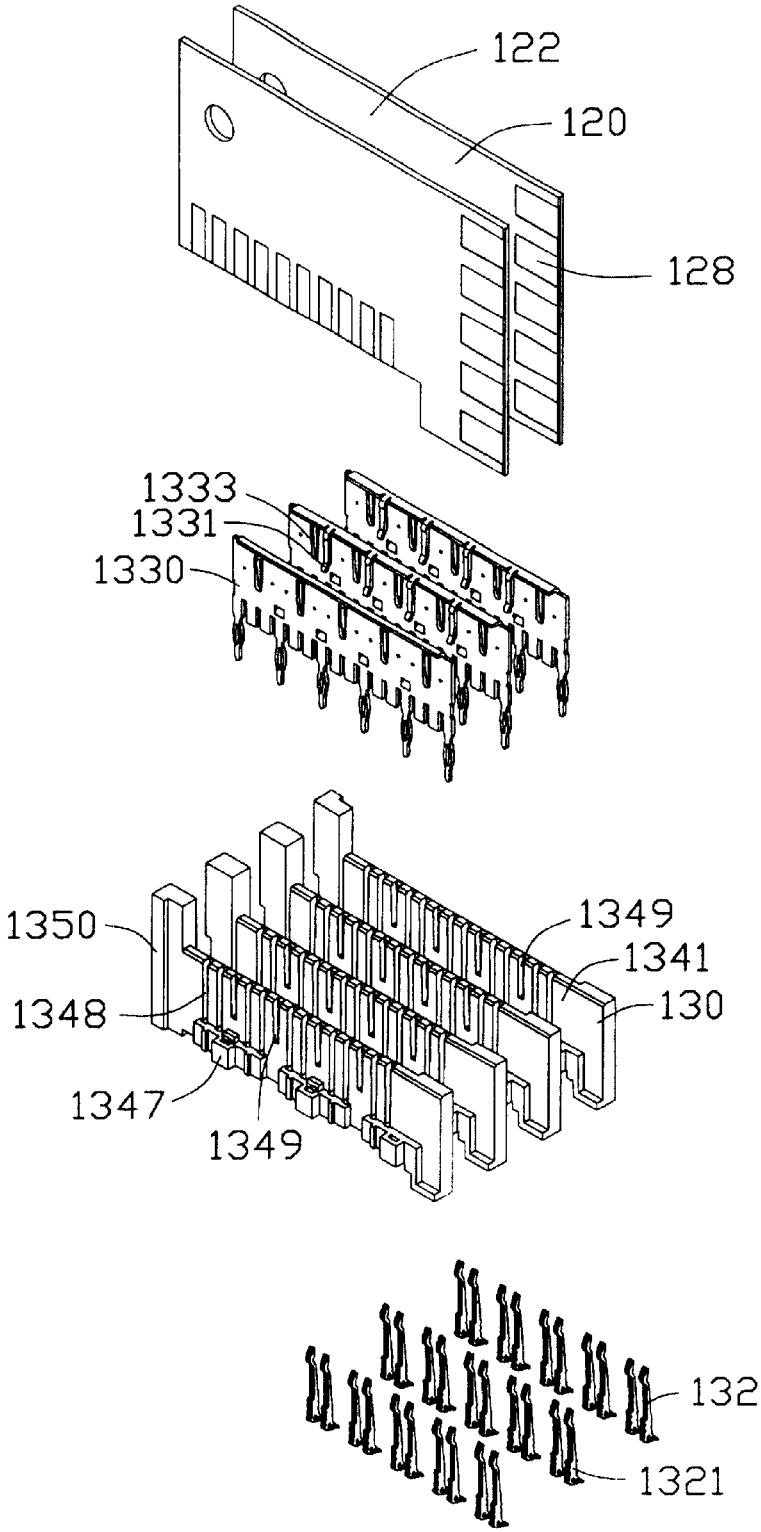
FIG. 7 is a view similar to FIG. 5, but taken from yet another perspective.

Referring also to FIGS. 5–7, each inner printed circuit board 120 comprises a first side 121, a second side 122 opposite to the first side 121, a mating portion 123 and a mounting portion 124. The first side 121 is formed with a plurality of signal pads (or gold fingers) 125 on the mating and the mounting portions 123, 124 thereof, a plurality of conductive traces 126 respectively electrically connect the signal pads 125, and a plurality of grounding planes 127 surrounding the signal pads 125 and the conductive traces 126. The second side 122 is adapted to provide a grounding referential and is formed with a plurality of grounding pads (gold fingers) 128 at the mating and the mounting portions 123, 124 thereof.

Each of the wafers 130 comprises an insulative wafer body 131, a plurality of signal contacts 132 and a grounding bus 133. The wafer body 131 comprises a retaining portion 134 and a shoulder 135 extending at one end of the retaining portion 134 with a top thereof protruding upwardly beyond a top of the retaining portion 134. The retaining portion 134 comprises a first side 1340, a second side 1341 opposite to the first side 1340, a plurality of first barbs 1343 extending outwardly adjacent to a lower section of the first side 1340, a plurality of recesses 1344 recessed from the first side 1340 and alternating with the first barbs 1343, a plurality of first channels 1345 extending downwardly from a top of the first side 1340 and located between every two adjacent first barb 1343 and recess 1344, a plurality of second barbs 1347 protruding outwardly from a lower portion of the second side 1341, a plurality of passageways 1348 extending vertically from the top 1341 through the bottom of the second side 1341, and a plurality of second channels 1349 extending downwardly between every two adjacent pairs of passageways 1348. Each of the first and the second barbs 1343, 1347 defines a hole 1346 extending vertically therethrough. The shoulders 135 of two of the wafer bodies 131 are formed with ribs 1350 protruding outwardly from one side surface thereof and the shoulders 135 of the other insulative bodies 131 have steps 1351 adjacent to a medial portion of an outward side thereof.

A pair of signal contacts 132 are adapted to be mounted to one passageway 1348 of the wafer body 131 and each of the signal contacts 132 comprises a fixing portion 1321 for retaining with the wafer body 131, an engaging portion 1320 extending upwardly from the fixing portion 1321 for electrically engaging with the signal pads 125 of the mounting portions 124 of the inner printed circuit boards 120 and a contact portion 1322 extending from the fixing portion 1321 beyond the bottom of the wafer body 131 for electrically engaging with the contacting pads 20 of the printed circuit board 2. The contact portion 1322 of each signal contact 132 defines an angle with respect to the fixing and the engaging portions 1321, 1320.

The grounding bus 133 comprises a generally flat plate portion 1330 for being attached to the first side 1340 of the wafer body 131, a plurality of fingers 1331 extending downwardly from a top of the plate portion 1330 and spaced from the plate portion 1330 for extending along the second channels 1349 of the second side 1341 of the wafer body 131 to electrically contact the grounding planes 127 of the mounting portions 124 of the inner printed circuit boards 120, and a plurality of spaced tails 1332 extending downwardly from a bottom edge of the plate portion 1330. The plate portion 1330 is formed with a plurality of tabs 1333 for extending downwardly and slightly outwardly along the first channels 1345 of the first side 1340 of the wafer body 131 to electrically contact the grounding pads 128 of the mounting portions 124 of the inner printed circuit boards 120 and a plurality of flanges 1334 bent substantially perpendicular thereto below the tabs 1333.

The wafers 130 are assembled together in such a way that the second barbs 347 of the second side 1341 of one wafer body 131 engage with the recesses 1344 of the first side 1340 of another adjacent wafer body 131 and the tails 1332 of each grounding bus 133 extend through the holes 1346 of the first and the second blocks 1343, 1348 of the two adjacent wafer bodies 131, respectively, into the through holes 21 of the printed circuit board 2. The two wafer bodies 131 with the ribs 1350 on the shoulders 135 thereof are arranged as two outmost ones of the subassembly of the wafers 130.

Figure 8:
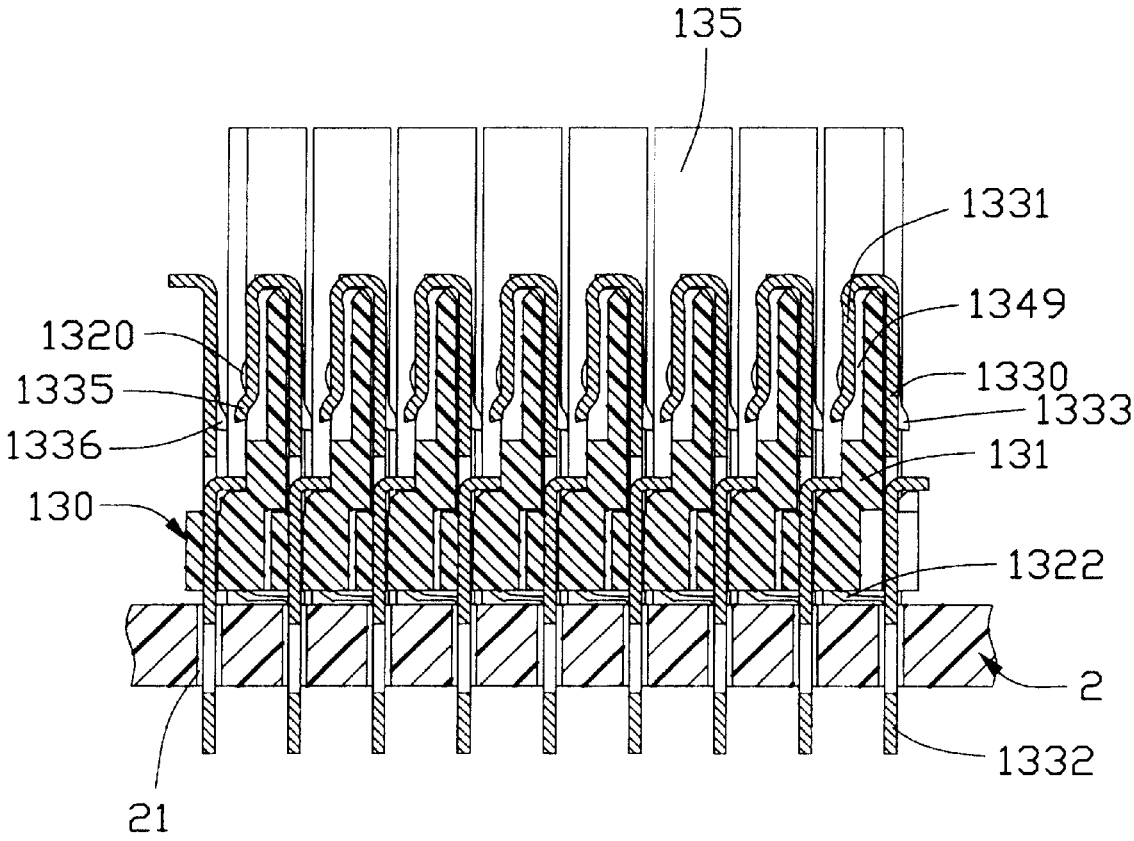
FIG. 8 is a cross-sectional view of assembled wafers of the electrical receptacle connector of FIG. 1 when mounting to the printed circuit board.
Figure 9:
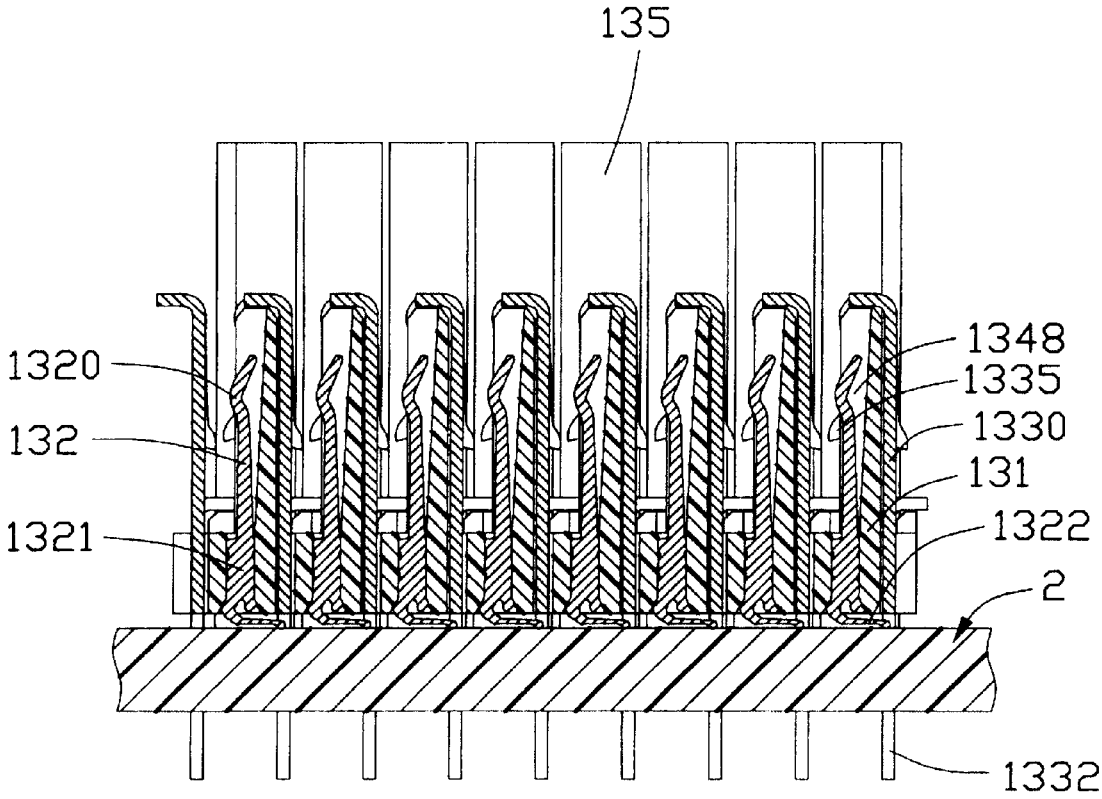
FIG. 9 is a view similar to FIG. 8.

Referring also to FIGS. 8 and 9, the fingers 1331, the tabs 1333 and the engaging portions 1320 of the signal contacts 132 are stagger with respect to each other, that is, distances from the bottoms of the wafers 130 to contacting portions 1335 of the fingers 1331 are larger than distances from the bottoms of the wafers 130 to contacting portions 1336 of the tabs 1333 and smaller than distances from the bottoms of the wafers 130 to the engaging portions 1320 of the signal contacts 132, and a line extending through the fingers 1331 of all of the wafers 130 will not extend through any of the signal contacts 132 or the tabs 1333.

The mounting portions 124 of the inner printed circuit boards 120, as we know, are inserted into between the wafers 130 during the course of assembling the inner printed circuit boards 120 to the subassembly of the wafers 130 until being stopped and supported by the flanges 1334 of the grounding buses 130. Since the fingers 1331, the tabs 1333 and the engaging portions 1320 of the signal contacts 132 are stagger, so the insertion force of the inner printed circuit boards 120 is divided along the inner printed circuit boards 120 and is significantly reduced, thereby simplifying the assembly procedure.

The subassembly of the inner printed circuit boards 120 and the wafers 130 is then assembled to the main portion 111 of the insulative housing 110 in such a way that the inner printed circuit boards 120 are substantially accommodated in the slots 114 with the mating portions 123 of the inner printed circuit boards 120 extending into the mating cavity 113 of the main portion 111 of the insulative housing 110. The wafers 130 are accommodated in the mounting cavity 115 of the main portion 111 of the insulative housing 110. The hook sections 1191 of the latches 119 of the fastening portion 112 extend into the cutouts 117 and the channels 1181 of the cover section 118 of the fastening portion 112 engage with the ribs 1350 of the wafers 130 while the block 1182 of the cover section 118 of the fastening portion 112 engages with the steps 1351 of wafers 130. In such a way, the electrical receptacle connector 100 is assembled.

Figure 10:
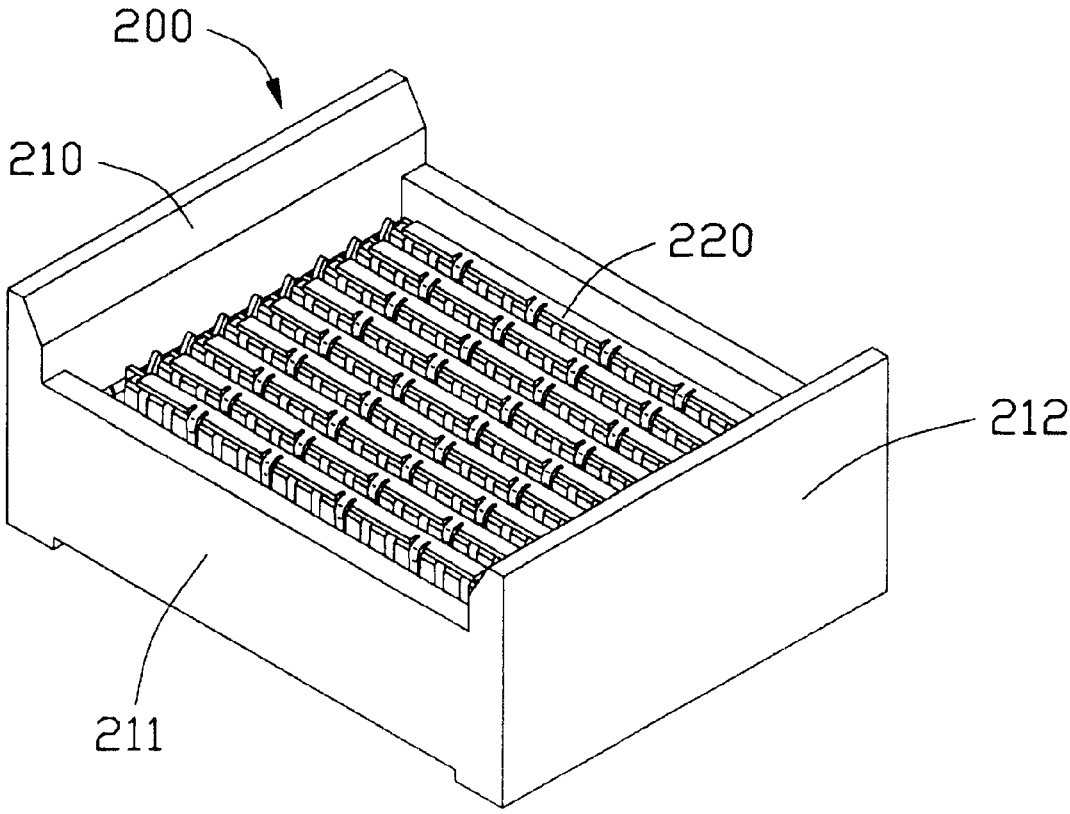
FIG. 10 is a perspective view of an electrical header connector of the high density electrical connector assembly in accordance with the first embodiment of the present invention.
Figure 11:
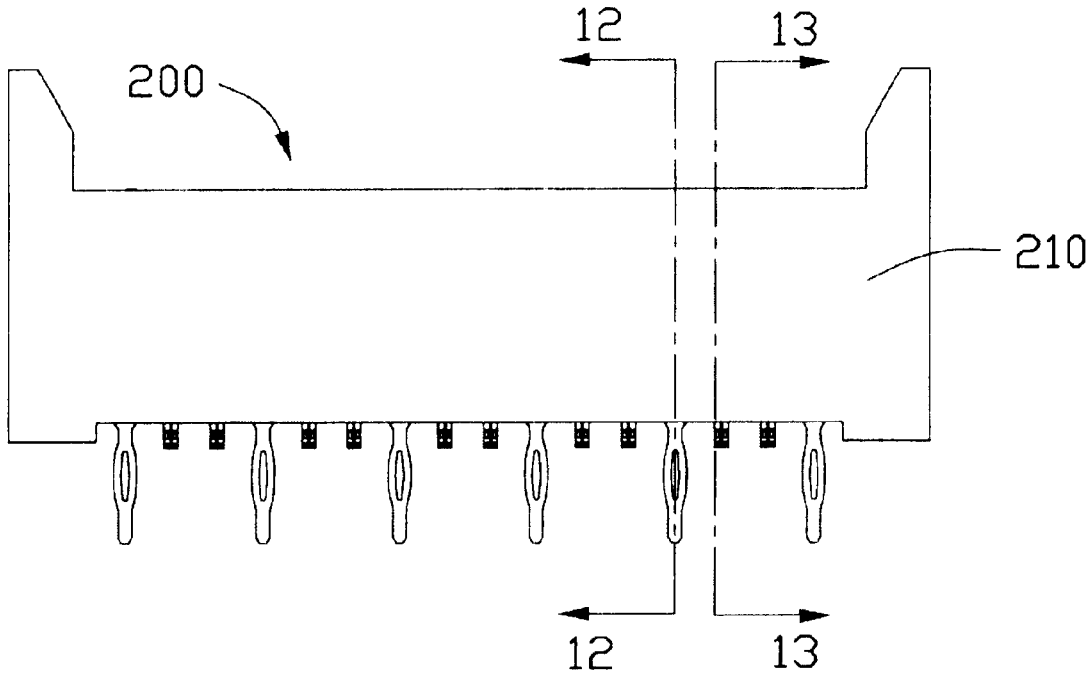
FIG. 11 is a side elevational view of the electrical header connector of FIG. 10.

Referring to FIGS. 10 to 11, an electrical header connector 200 complementary to the electrical receptacle connector 100 of the high density electrical connector assembly in accordance with the first embodiment of the present invention comprises an insulative housing 210 and a plurality of wafers 220 accommodated in the insulative housing 210.

Figure 12:
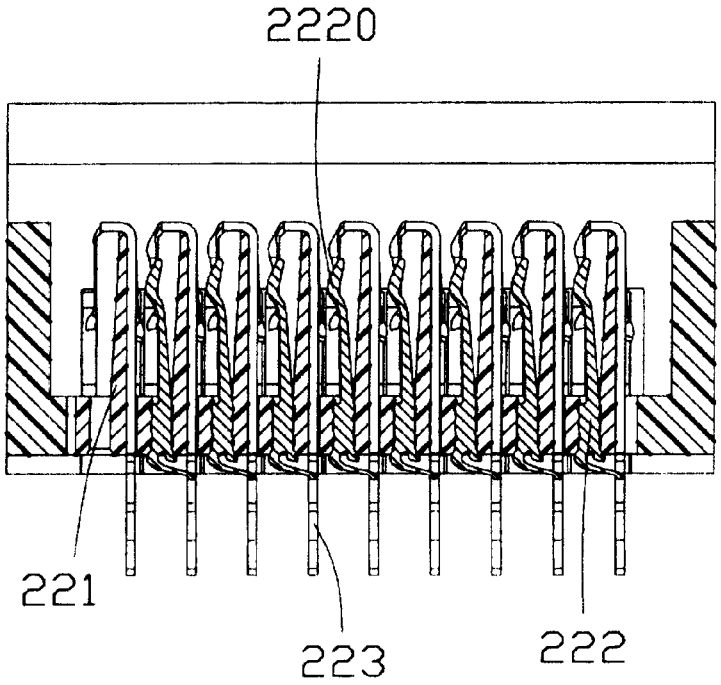
FIG. 12 is a cross-sectional view taken along line 12—12 of FIG. 11.
Figure 13:
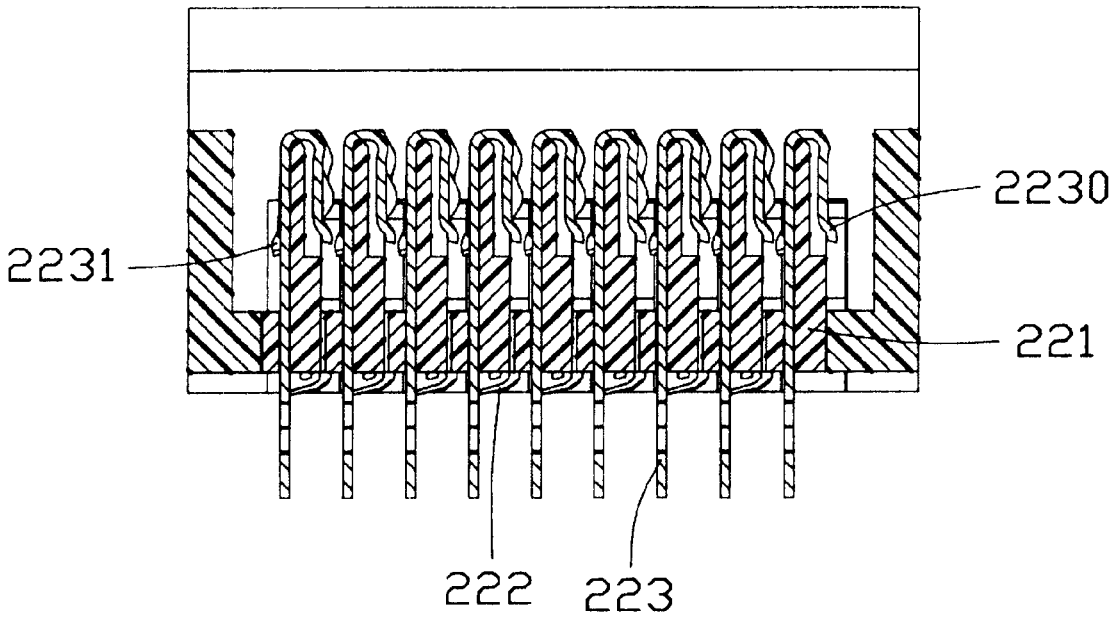
FIG. 13 is a cross-sectional view taken along line 13—13 of FIG. 11.

The insulative housing 210 comprises a pair of longitudinal walls 211 and a pair of lateral walls 212 connecting the longitudinal walls 211. Referring also to FIGS. 12 and 13, the wafers 220 are assembled to the insulative housing 210 to be located between the longitudinal and the lateral walls 211, 212 and are substantially similar to the wafers 130 of the electrical receptacle connector 100. Each wafer 220 thus also comprises an insulative wafer body 221, a plurality of signal contacts 222 and a grounding bus 223. Each signal contact 222 comprises an engaging portion 2220 for engaging with the signal pads 125 on the mating portions 123 of the inner printed circuit boards 120 of the electrical receptacle connector 100. The grounding bus 223 comprises a plurality of fingers 2230 for electrically engaging with the grounding planes 127 of the mating portion 123 of the inner printed circuit board 120, and a plurality of tabs 2231 for electrically contacting the grounding pads 128 of the mating portion 123 of the inner printed circuit board 120.

The fingers 2230, the tabs 2231 and the engaging portions 2220 of the signal contacts 222 are also staggerly arranged, so every time the electrical receptacle and header connectors 100, 200 are to be mated, the insertion force needed for inserting the mating portions 123 of the inner printed circuit boards 120 and in turn the electrical receptacle connector 100 to the electrical header connector 200 is significantly reduced.

Figure 14:
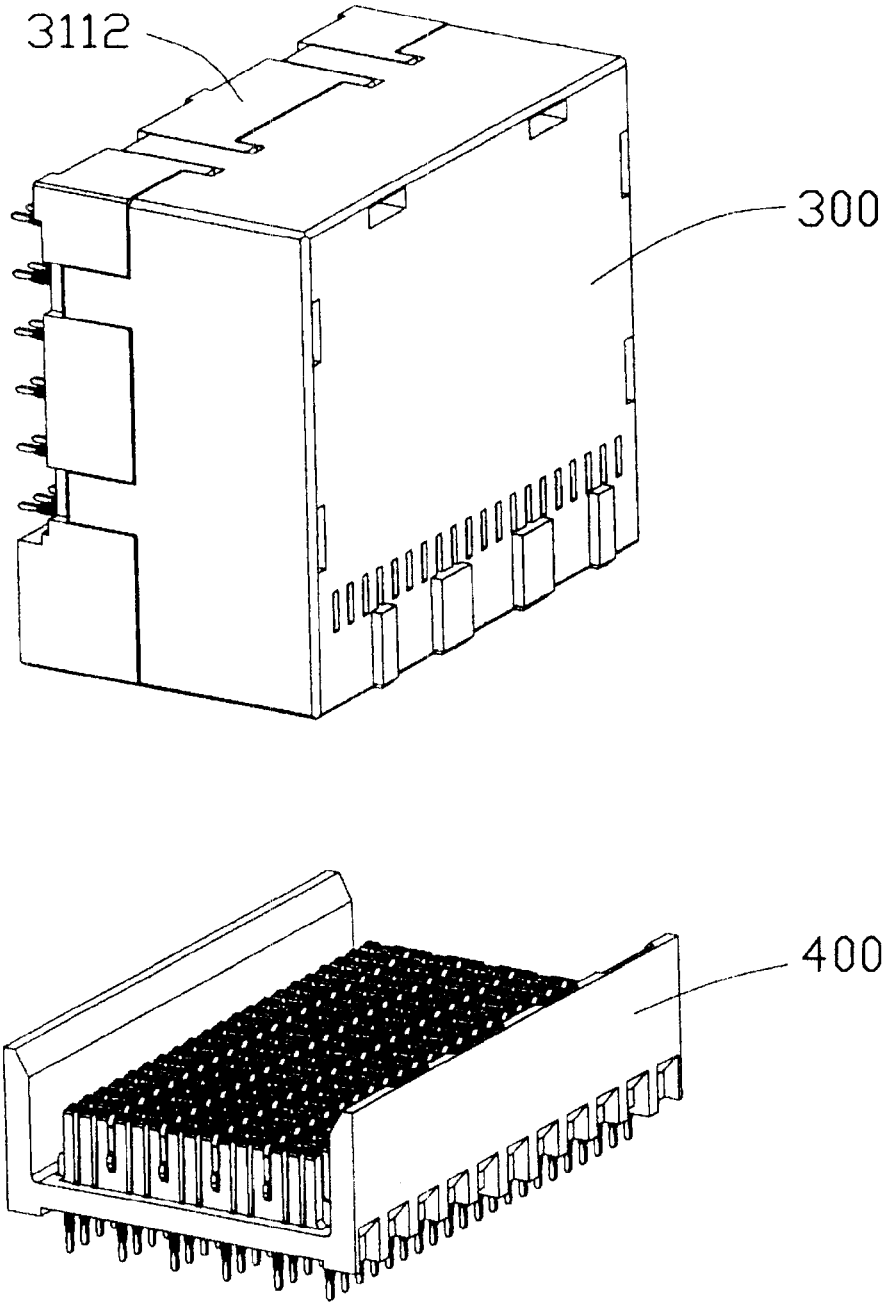
FIG. 14 is a perspective view of a high density electrical connector assembly in accordance with a second embodiment of the present invention when an electrical receptacle connector and an electrical header connector thereof are unmated.
Figure 15:
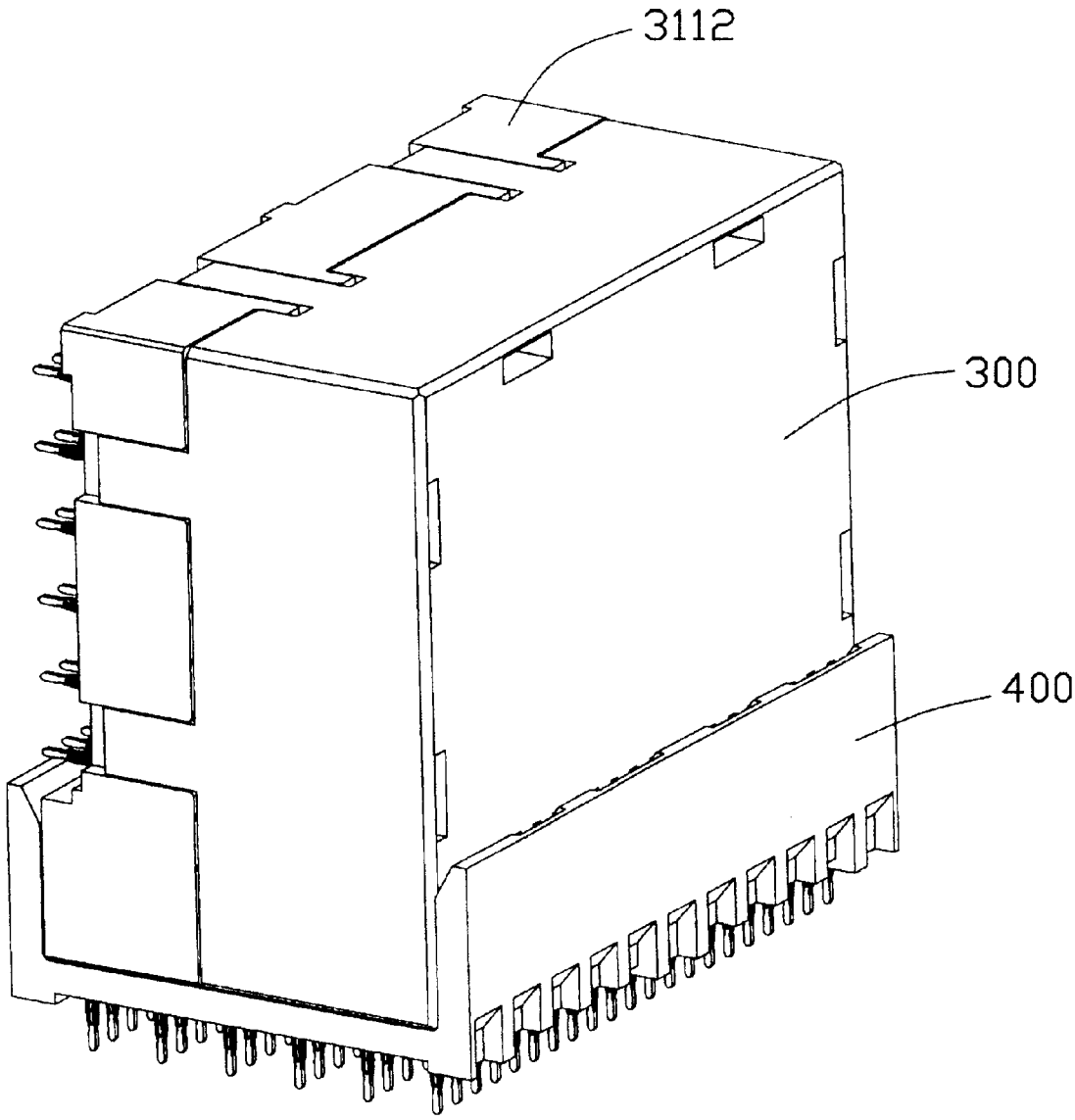
FIG. 15 is a view similar to FIG. 14, but the electrical receptacle connector and the electrical header connector are mated with each other.
Figure 16:
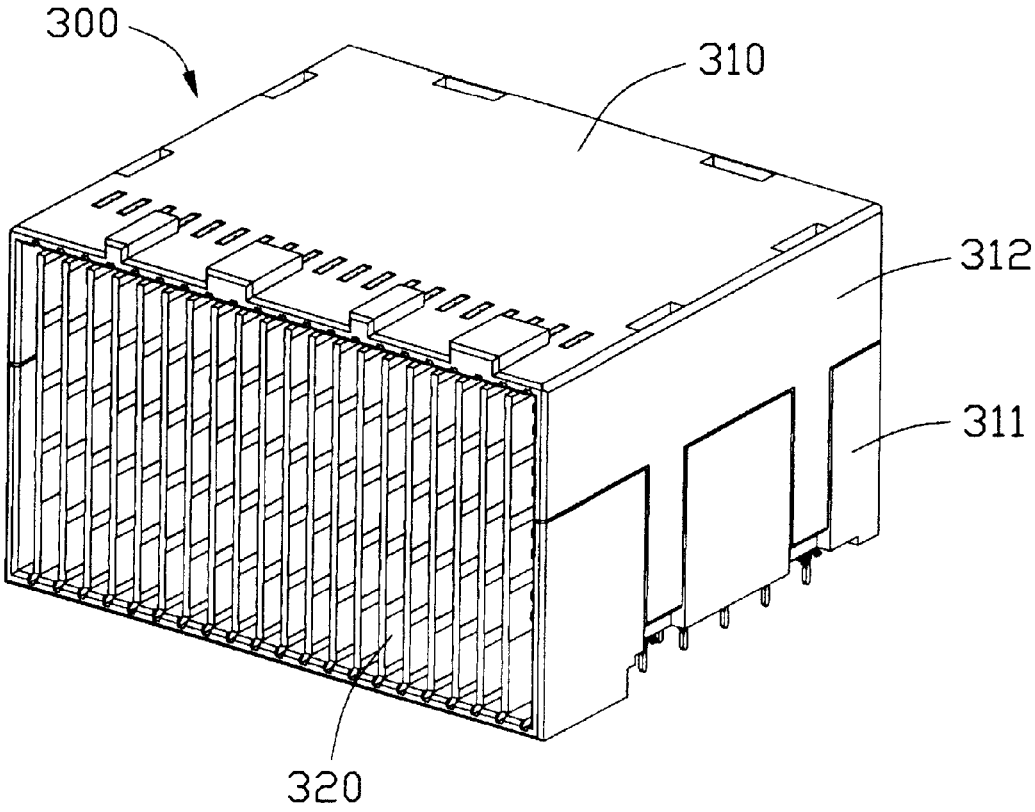
FIG. 16 is a perspective view of the electrical receptacle connector of the high density electrical connector assembly of FIG. 14.
Figure 17:
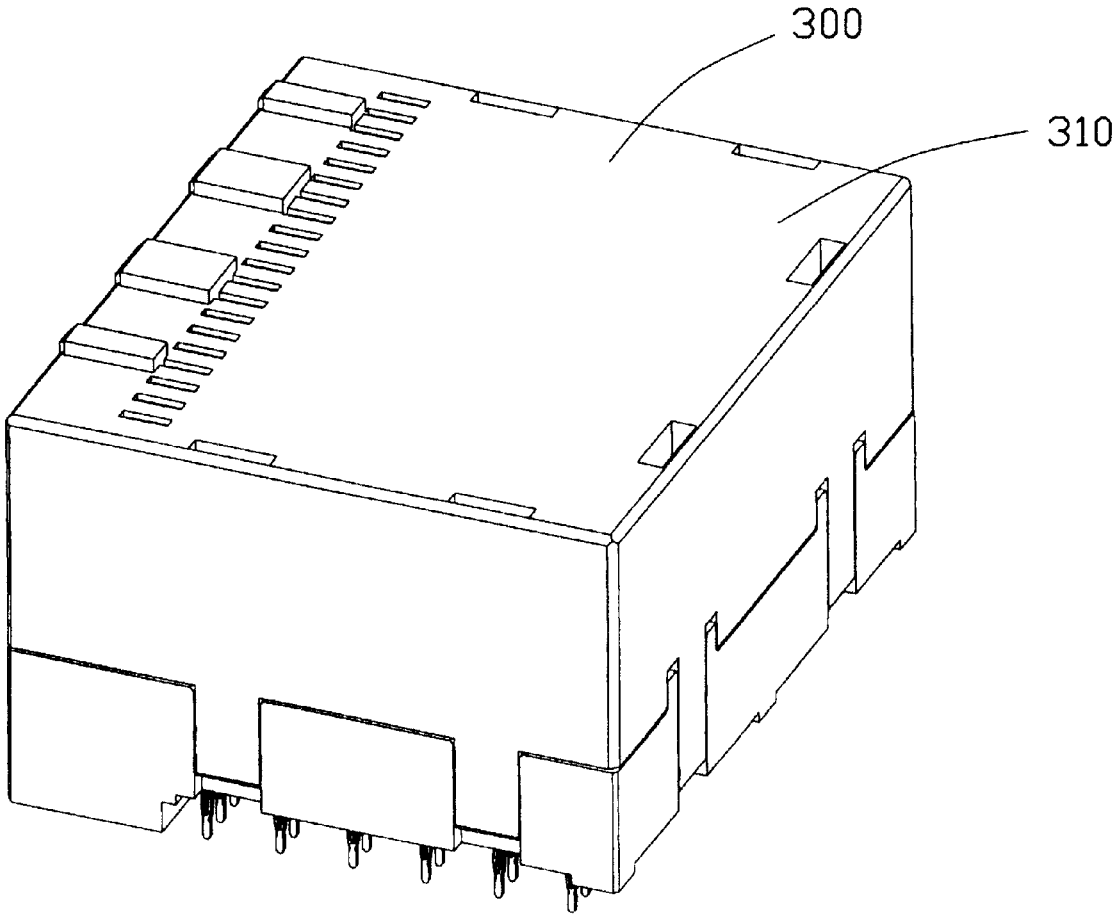
FIG. 17 is a view similar to FIG. 16, but taken from another perspective.
Figure 18:
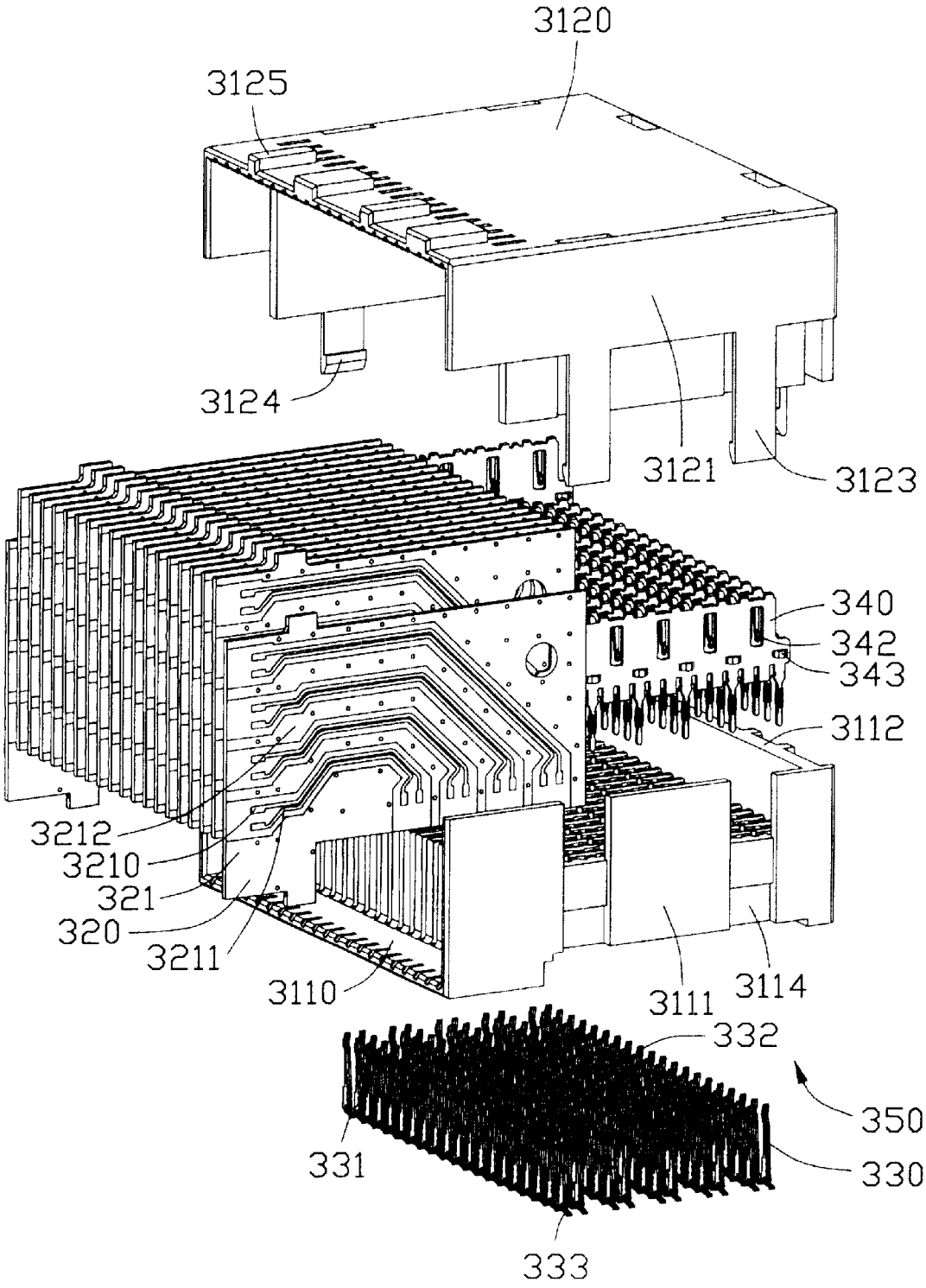
FIG. 18 is an exploded perspective view of the electrical receptacle connector of the high density electrical connector assembly of FIG. 14.
Figure 19:
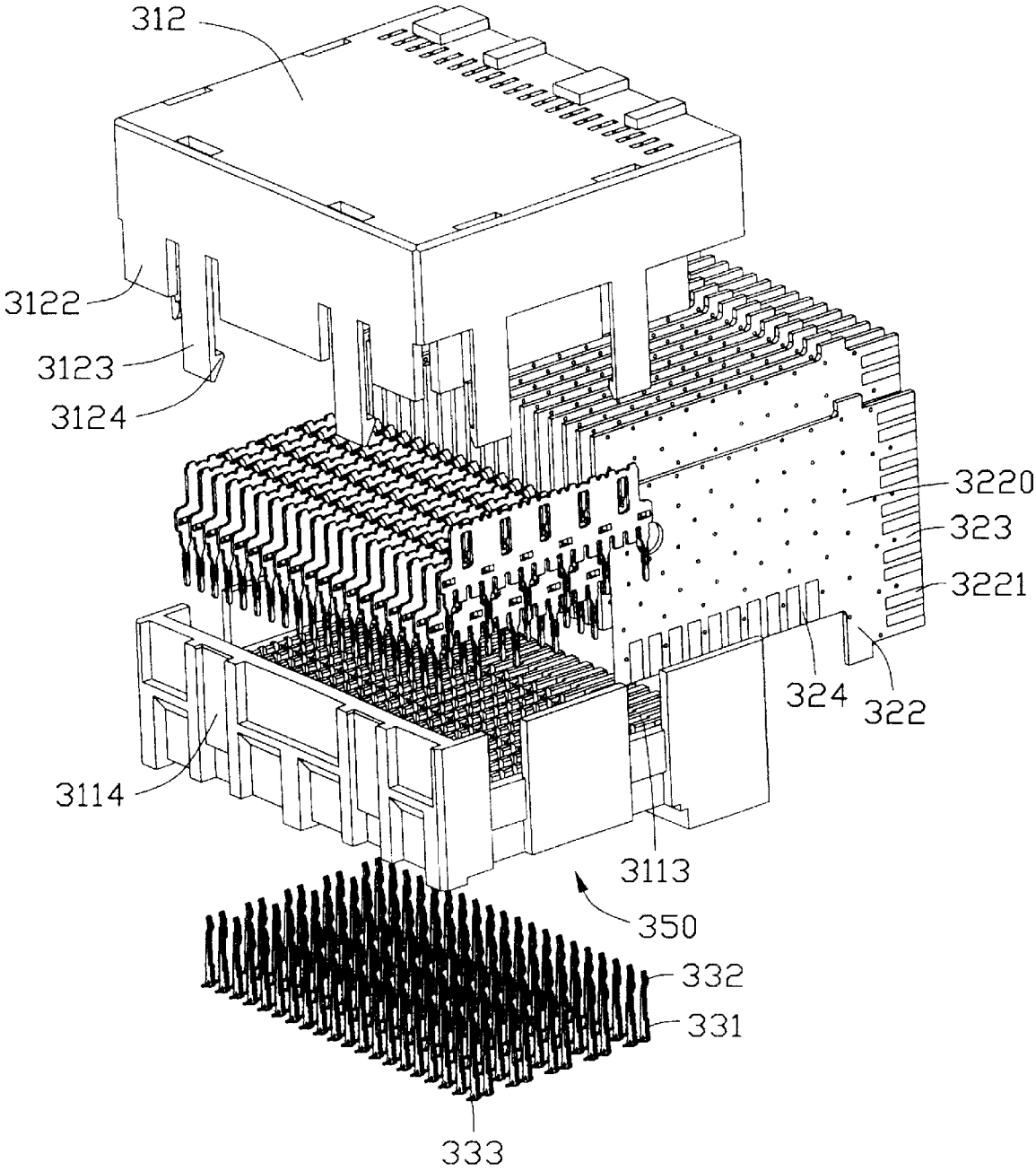
FIG. 19 is a view similar to FIG. 18 but taken from a different perspective.

Referring also to FIGS. 14 and 15, a high density electrical connector assembly in accordance with the second embodiment of the present invention comprises an electrical receptacle connector 300 and an electrical header connector 400 complementary to the electrical receptacle connector 300.

Referring to FIGS. 16 to 19, the electrical receptacle connector 300 comprises an insulative housing 310, a plurality of inner printed circuit boards 320, and a plurality of wafers 350.

The insulative housing 310 comprises a main portion 311 and a fastening portion 312. The main portion 311 comprises a bottom wall 3110, a pair of opposite side walls 3111 extending from two opposite sides of the bottom wall 3110 and a rear wall 3112 extending from the bottom wall 3110 and connecting the side walls 3111. Each of the side and the rear walls 3111, 3112 comprises a pair of locking channels 3114 extending vertically therealong.

The fastening portion 312 comprises a cover section 3120, a pair of side walls 3121 extending from two opposite sides of the cover section 3120 and a rear wall 3122 extending from the cover section 3120 and connecting the side walls 3121. The cover section 3120 is formed with a plurality of bumps 3125 adjacent to a front end thereof. Each of the side and the rear walls 3121, 3122 comprises a pair of latches 3123 for extending along the locking channels 3114 of the main portion 311 and each comprising a hook section 3124 for engaging with the bottom of the main portion 311 to latch the main portion 311 and the fastening portion 312 together.

Each of the inner printed circuit boards 320 comprises a first side 321, a second side 322 opposite to the first side 321, a mating portion 323 and a mounting portion 324. The first side 321 comprises a plurality of signal pads (gold fingers) 3210 on the mating and the mounting portions 323, 324, a plurality of conductive traces 3211 extending between and electrically connecting the signal pads 3210 of the mating and the mounting portions 323, 324, and a plurality of grounding planes 3212 surrounding the signal pads 3210 and the conductive traces 3211. The second side 322 of the inner printed circuit board 320 is adapted to provide a grounding referential and comprises a plurality of grounding pads (gold fingers) 3221 on the mating and the mounting portions 323, 324.

Each wafer 350 comprises an insulative wafer body 3113 extending from the bottom wall 3110 and between the side and the rear walls 3110, 3112 of the main portion 311 of the insulative housing 310, a plurality of signal contacts 330 mounted to the wafer body 3113 and a grounding bus 340 mounted to the wafer body 3113. The wafer bodies 3113 are formed somewhat like the wafer bodies 131 of the electrical receptacle connector 100 of the first embodiment, so a detailed description thereabout is omitted herefrom.

The signal contacts 330 and the grounding buses 340 are substantially similar to the signal contacts 132, 222 and the grounding buses 133, 223 of the first embodiment and are mounted to the wafer bodies 3113 in substantially the same way as the signal contacts 132, 222 and the grounding buses 133, 223 of the first embodiment. Each signal contact 330 comprises a fixing portion 331 for retaining to the wafer body 3113, an engaging portion 332 extending from the fixing portion 331 for electrically engaging with the signal pads 3210 of the inner printed circuit board 320 and a contact portion 333 extending from the fixing portion 331 beyond the wafer body 3113 for electrically contacting with contacting pads (not shown) on a printed circuit board (not shown) to which the electrical receptacle connector 300 is mounted. Each grounding bus 340 comprises a plurality of fingers 341 for electrically contacting the grounding planes 3212 of the mounting portion 324 of the inner printed circuit board 320, a plurality of tabs 342 for electrically mating with the grounding pads 3221 of the mounting portion 324 of the inner printed circuit board 320 and a plurality of flanges 343 curved beyond one side surface of the grounding bus 340 for stopping and supporting the mounting portion 324 of the inner printed circuit board 320.

Figure 20:
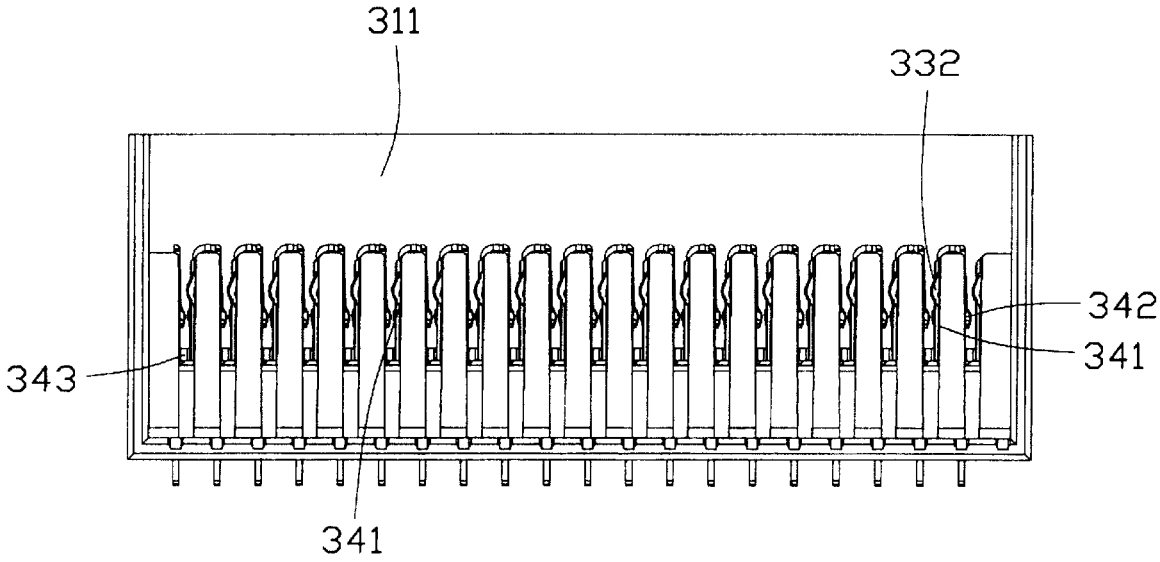
FIG. 20 is a cross-sectional view of the electrical receptacle connector with a fastening portion of an insulative housing and inner printed circuit boards thereof being removed therefrom.

Referring also to FIG. 20, the fingers 341, the tabs 342 of the grounding buses 340 and the engaging portions 332 of the signal contacts 330 are also stagger with respect to each other, so an insertion force needed to insert the mounting portions 324 of the inner printed circuit boards 320 into between the wafer 350 for the purpose of assembling the inner printed circuit boards 320 with the wafers 350 is reduced, thereby simplifying the assembly procedure of the electrical receptacle connector 300.

Figure 21:
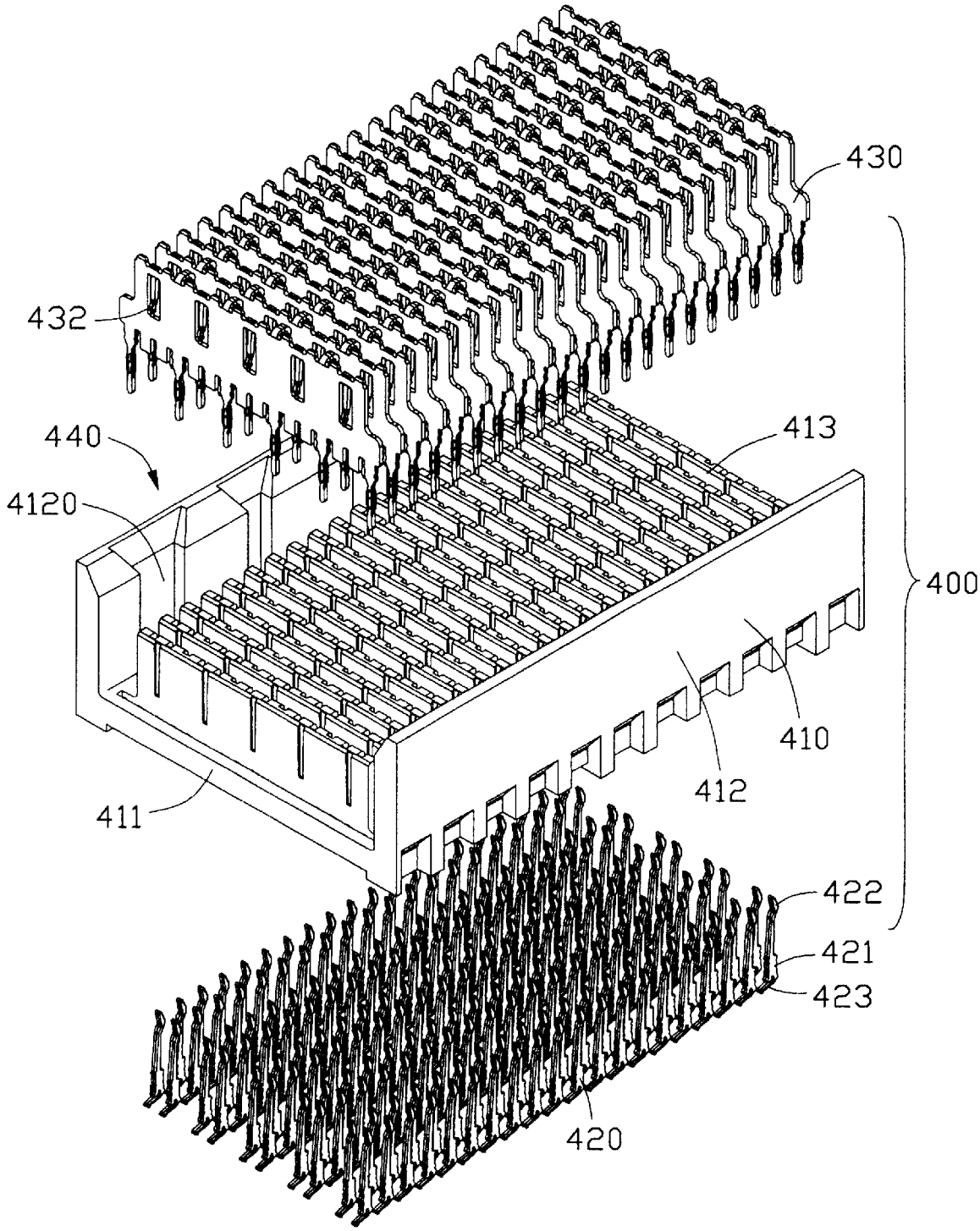
FIG. 21 is an exploded perspective view of the electrical header connector of FIG. 14.
Figure 22:
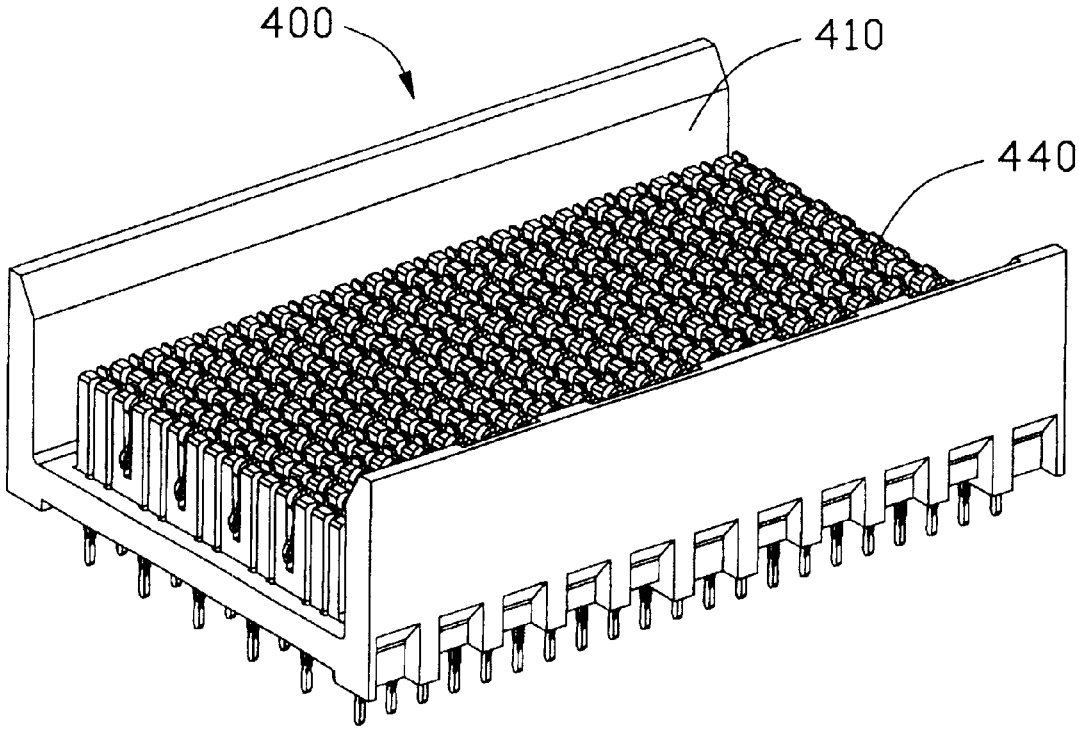
FIG. 22 is an assembled perspective view of FIG. 21.

Referring also to FIGS. 21 and 22, an electrical header connector 400 of the high density electrical connector assembly in accordance with the second embodiment of the present invention comprises an insulative housing 410 and a plurality of wafers 440. The insulative housing 410 comprises a bottom wall 411 and a pair of opposite side walls 412 extending from two sides of the bottom wall 411. One of the side walls 412 defines a plurality of grooves 4120 for receiving the bumps 3125 of the electrical receptacle connector 300 to provide a retention therebetween in the mating of the two electrical connectors 300, 400.

Each wafer 440 comprises a wafer body 413 extending from the bottom wall 411 and between the opposite side walls 412 of the insulative housing 410, a plurality of signal contacts 420 and a grounding bus 430. The wafer bodies 413 are configured substantially similar to the wafer bodies 131, 220 of the first embodiment and the wafer bodies 3113 of the electrical receptacle connector 300 of this embodiment, so a detailed description thereof is also omitted herefrom.

The signal contacts 420 and the grounding buses 430 are also configured similar to all of the above-mentioned signal contacts and grounding buses and are mounted to the wafer bodies 413 in substantially the same way as those ones. Each signal contact 420 comprises also a fixing portion 421 retained to the wafer body 413, an engaging portion 422 for electrically engaging with the signal pads 3221 of the mating portions 323 of the inner printed circuit boards 320 of the electrical receptacle connector 300 and a contact portion 423 extending beyond the insulative housing 410 for electrically connected with a printed circuit board (not shown) to which the electrical header connector 400 is mounted. The grounding bus 430 comprises also a plurality of fingers 431 (see FIG. 25) for electrically contacting with the grounding planes 3212 on the mating portions 323 of the inner printed circuit boards 320 of the electrical receptacle connector 300 and a plurality of tabs 432 for electrically engaging with the grounding pads 3221 of the mating portions 323 of the inner printed circuit boards 320 of the electrical receptacle connector 300.

Figure 23:
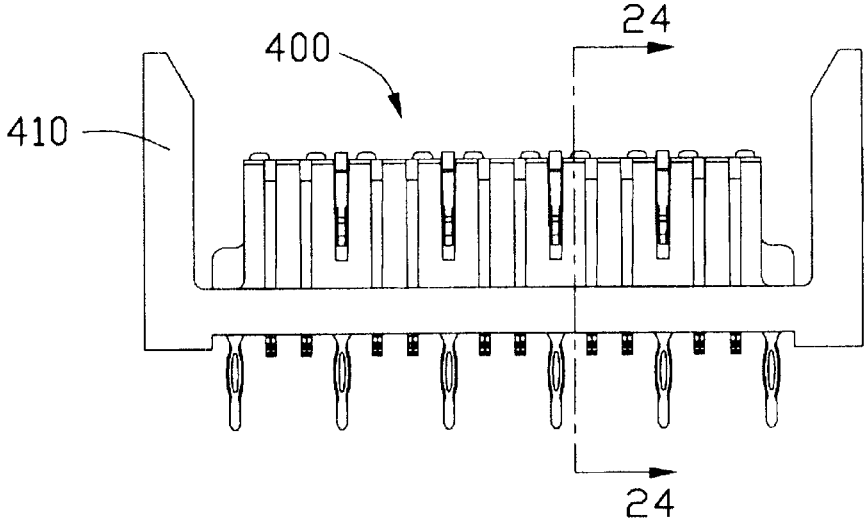
FIG. 23 is a side elevational view of the electrical header connector of FIG. 22.
Figure 24:
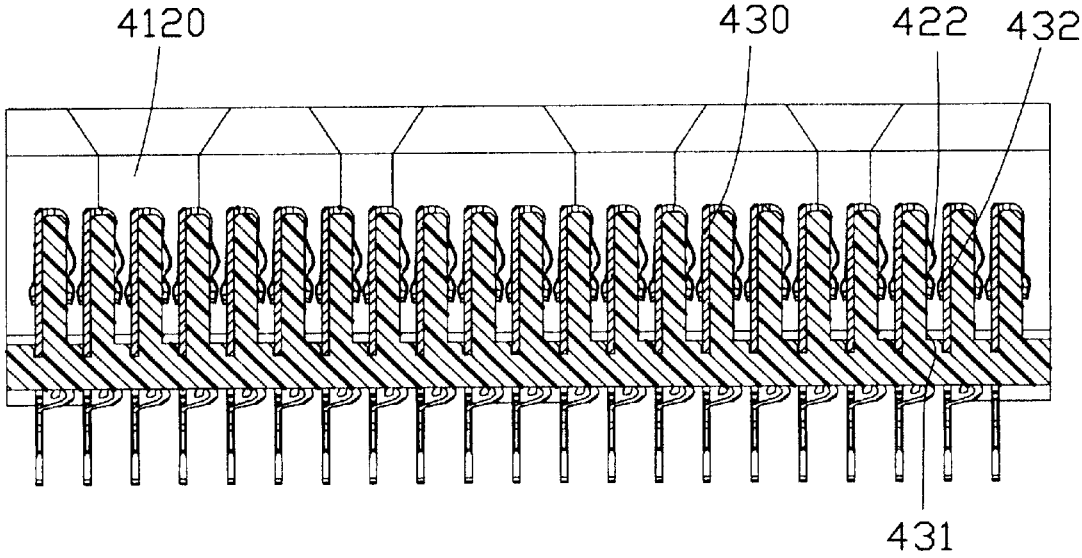
FIG. 24 is a cross-sectional view taken along line 24—24 of FIG. 23.

Referring also to FIGS. 23 and 24, the fingers 431, the tabs 432 and the engaging portions 422 of the signal contacts 420 are also stagger with respect to each other, thus, every time the electrical receptacle connector 300 is to be mated with the electrical header connector 400, the insertion force for the mating portions 323 of the inner printed circuit boards 320 into between the wafers 440 of the electrical header connector 400 is reduced and so does the mating force of the two connectors 300, 400.

Although the above-mentioned wafer bodies, signal contacts and grounding buses are similar, they can be different, if desired, within the principles of the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing;

a plurality of inner printed circuit boards; and a plurality of wafers being accommodated in the insulative housing and receiving therebetween the inner printed circuit boards, each wafer comprising an insulative wafer body, a plurality of signal contacts mounted to the wafer body and electrically contacting the inner printed circuit boards, and a grounding bus mounted to the wafer body, the grounding bus comprising a finger to electrically contact the inner printed circuit board, the finger and the signal contacts being stagger with respect to each other.

2. The electrical connector as claimed in claim 1, wherein the wafer body is integral with the insulative housing.

3. The electrical connector as claimed in claim 1, wherein the wafer body is assembled to insulative housing.

4. The electrical connector as claimed in claim 1, wherein each of the grounding buses comprises a tab electrically contacting with the inner printed circuit board and wherein a line extending through the fingers of the grounding buses of the wafers extends through none of the tabs of the grounding buses and the signal contacts.

5. The electrical connector as claimed in claim 1, wherein each of the wafer bodies comprises a first side comprising a plurality of first barbs and a second side opposite to the first side and comprising a plurality of second barbs, and wherein each of the grounding buses comprises a plurality of spaced tails extending through both the first barbs of one of the wafer bodies and the second barbs of another of the wafer bodies adjacent to the one of the wafer bodies.

6. The electrical connector as claimed in claim 1, wherein each of the inner printed circuit boards comprises a mating portion adapted for electrically engaging with a complementary electrical connector and a mounting portion inserted between every two adjacent wafers to electrically contact the signal contacts of one of the two adjacent wafers and the grounding buses of the two adjacent wafers.

7. The electrical connector as claimed in claim 1, wherein each of the signal contacts comprising an engaging portion electrically engaging with the inner printed circuit boards, and wherein a distance from a bottom of the wafer body to the engaging portion of the signal contact is larger than a distance from the bottom of the wafer body to the finger of the grounding bus.

8. The electrical connector as claimed in claim 7, wherein each of the grounding buses comprises a tab to electrically contact the inner printed circuit board and wherein the distance from the bottom of the wafer body to the finger of the grounding bus is larger than a distance from the bottom of the wafer body to the tab of the grounding bus.

9. The electrical connector as claimed in claim 8, wherein each of the wafer bodies comprises a first side and a second side opposite to the first side, and wherein the tab of the grounding bus extends along the first side of the wafer body and the signal contacts and the finger of the grounding bus extend along the second side of the wafer body.

10. The electrical connector as claimed in claim 9, wherein each of the inner printed circuit boards comprises a first side to electrically engage with the tab of the grounding bus of the wafer and a second side opposite to the first side and electrically engaging with the finger of the grounding bus and the signal contacts.

11. An electrical connector comprising:

an insulative housing; and a plurality of wafers being accommodated in the insulative housing, each of the wafers comprising a wafer body, a plurality of signal contacts mounted to the wafer body and a grounding bus attached to the wafer body, each of the signal contacts comprising an engaging portion, the grounding bus comprising a plurality of fingers extending beside the signal contacts, a distance from a bottom of the wafer to the engaging portion of the signal contact being larger than a distance from the bottom of the wafer to the finger of the grounding bus.

12. An electrical connector as claimed in claim 11, wherein the insulative housing comprises a bottom wall and a pair of side walls extending from the bottom wall, and wherein the wafer bodies extend from the bottom wall and between the side walls.

13. An electrical connector as claimed in claim 11, wherein the wafer bodies are parallelly arranged in the insulative housing and each of the wafer bodies comprises a first side, and wherein each grounding bus comprises a plurality of tabs extending along the first side of the wafer body.

14. An electrical connector as claimed in claim 13, wherein each of the wafer bodies comprises a second side opposite to the first side, and wherein the signal contacts and the fingers of the grounding buses extend along the second sides of the wafer bodies.

15. An electrical connector assembly, comprising:

an electrical header connector comprising an insulative housing, a plurality of wafers in the insulative housing and a plurality of inner printed circuit boards accommodated in the insulative housing, each of the wafers comprising a wafer body, a plurality of signal contacts mounted to the wafer body and a grounding bus mounted to the wafer body, each of the inner printed circuit boards comprising a mounting portion extending into between every two adjacent wafers to electrically contact the signal contacts and the grounding buses and a mating portion; and an electrical header connector comprising an insulative housing and a plurality of wafers arranged in the insulative housing to receive therebetween the mating portions of the inner printed circuit boards of the electrical receptacle connector, each of the wafers comprising a wafer body, a plurality of signal contacts mounted to the wafer body and electrically engaging with the inner printed circuit boards, and a grounding bus mounted to the wafer body and electrically contacted with the inner printed circuit boards.

16. The electrical connector assembly as claimed in claim 15, wherein the insulative housing of the electrical receptacle connector comprises a cover section formed with a plurality of bumps and the insulative housing of the electrical header connector comprises a side wall defining a plurality of grooves to engage with the bumps.

17. The electrical connector assembly as claimed in claim 15, wherein the insulative housing of the electrical receptacle connector comprises a main portion and a fastening portion retained to the main portion, and wherein the wafers and the inner printed circuit boards are enclosed by the main portion and the fastening portion of the insulative housing of the electrical receptacle connector.

18. The electrical connector assembly as claimed in claim 17, wherein the main portion of the electrical receptacle connector defines a plurality of locking channels and the fastening portion of the electrical receptacle connector comprises a plurality of latches extending through the locking channels and each comprising a hook section locked to the main portion.

19. An electrical connector comprising:

an insulative housing;

a plurality of wafer-like plates disposed in the housing in a parallel relation;

a plurality of grooves defined between every adjacent two plates;

a plurality of inner printed circuit boards received in the corresponding grooves, respectively;

a plurality of grounding buses each disposed by one side of the corresponding plate and facing to the corresponding adjacent groove, said each grounding bus defining first grounding tangs extending into said corresponding adjacent groove and second grounding tangs extending into another adjacent groove cooperating with said corresponding adjacent groove to sandwich the corresponding plate therebetween;

a plurality of signal contacts disposed on the other side of each of said plates and extending into said another adjacent groove; wherein the first and second grounding tangs electrically connect to grounding circuits of the printed circuit board, the signal contacts electrically connect to signal circuits of the printed circuit board, and contact apexes of said first grounding tang, said second grounding tang and the signal contact are positioned at levels different from one another.

* * * * *